US007222649B1

(12) United States Patent
Fox

(10) Patent No.: US 7,222,649 B1
(45) Date of Patent: May 29, 2007

(54) HANDBAG WITH INTERCHANGEABLE DECORATIVE PANELS

(76) Inventor: Janet Fox, 5 Cousins Ct., Ronkonkoma, NY (US) 11779

( * ) Notice: Subject to any disclaimer, the term of this patent is extended or adjusted under 35 U.S.C. 154(b) by 0 days.

(21) Appl. No.: 10/982,988

(22) Filed: Nov. 8, 2004

(51) Int. Cl.
*A45C 3/08* (2006.01)

(52) U.S. Cl. ..... 150/105; 150/104; 150/129; 190/26; 190/125; 383/111; 383/907

(58) Field of Classification Search ..... 150/100, 150/103–105, 127–129; 383/111, 907; 190/26, 190/110, 125, 126; D3/232, 234, 245
See application file for complete search history.

(56) References Cited

U.S. PATENT DOCUMENTS

| | | | | | |
|---|---|---|---|---|---|
| 1,990,360 | A | * | 2/1935 | Anish | 150/105 |
| 2,006,463 | A | * | 7/1935 | Landis | 150/104 |
| 2,051,092 | A | * | 8/1936 | Landis | 150/105 |
| D107,293 | S | * | 11/1937 | Pichel | D3/245 |
| 2,131,382 | A | * | 9/1938 | Lobel | 150/105 |
| 2,338,279 | A | * | 1/1944 | Blake | 383/66 |
| D158,578 | S | * | 5/1950 | James | D3/233 |
| 2,522,549 | A | * | 9/1950 | Waggoner | 150/104 |
| 2,627,885 | A | * | 2/1953 | Cassel | 150/105 |
| 2,648,366 | A | * | 8/1953 | Higbee et al. | 206/570 |
| 2,653,640 | A | * | 9/1953 | Browning | 150/105 |
| 2,845,974 | A | * | 8/1958 | Arden | 150/105 |
| 3,182,701 | A | * | 5/1965 | Ginsburg | 150/105 |
| 3,340,969 | A | * | 9/1967 | Rothberg | 190/1 |
| 4,112,991 | A | * | 9/1978 | Barbaresi | 150/104 |
| D254,341 | S | * | 3/1980 | Sacks | D3/238 |
| 5,207,254 | A | * | 5/1993 | Fromm | 150/104 |
| 5,533,558 | A | * | 7/1996 | Carey et al. | 150/105 |
| D385,452 | S | * | 10/1997 | Marti | D6/601 |
| D395,751 | S | * | 7/1998 | Dominique | D3/233 |
| D420,794 | S | * | 2/2000 | Kohlhase | D3/246 |
| D422,405 | S | * | 4/2000 | du Sartel | D3/238 |
| D501,313 | S | * | 2/2005 | Kim | D3/238 |

* cited by examiner

*Primary Examiner*—Sue A. Weaver
(74) *Attorney, Agent, or Firm*—Myron Amer P.C.

(57) ABSTRACT

Adding a decorative panel in a display position about a handbag by positioning opposite panel side edges beneath straps that fold about outer edges over the panel side edges and are held against unfolding movement by the curvature of the outer edges.

2 Claims, 3 Drawing Sheets

HANDBAG WITH INTERCHANGEABLE DECORATIVE PANELS

The present invention relates generally to improvements for a handbag, the improvements more particularly are concerned generally with interchangeable display panels for appearance enhancement, a currently known prior art practice, but as herein practiced providing facilitated design panel attachment and obviating inadvertent detachment and instead requiring intended but nevertheless readily implemented detachment, to the end of contributing to display panel interchangeability.

BACKGROUND OF THE INVENTION

Field of the Invention

It is already well known in the prior art, as exemplified by U.S. Pat. No. 5,533,558 for "CREATIVE PURSE WITH INTERCHANGEABLE DECORATIVE COVERING" issued to Carey on Jul. 9, 1996, to enhance handbag appearance by screwing a decorative panel to a metal frame of the handbag, but the tradeoff in this and all other known patents is that the release of the thusly firmly attached decorative panel makes it difficult to exercise the option of using interchangeable decorative panels because achieving release requires undoing the firm attachment of the decorative panel to be replaced and again exerting the effort required to firmly attach the replacement decorative panel. What is lacking is a firm attachment technique, but one compatible with a facilitated release technique, and this conundrum remains unsolved.

SUMMARY OF THE INVENTION

Broadly, it is an object of the present invention to overcome the foregoing and other shortcomings of the prior art.

More particularly, it is an object using a folding and unfolding of decorative panel-gripping components to attach by said folding and detach by said unfolding a selected decorative panel, to thereby significantly contribute to decorative panel interchangeability and other attendant benefits.

BRIEF DESCRIPTION OF THE SEVERAL VIEWS OF THE DRAWINGS

The description of the invention which follows, together with the accompanying drawings should not be construed as limiting the invention to the example shown and described, because those skilled in the art to which this invention appertains will be able to devise other forms thereof within the ambit of the appended claims.

DETAILED DESCRIPTION OF THE INVENTION

Figure 1:
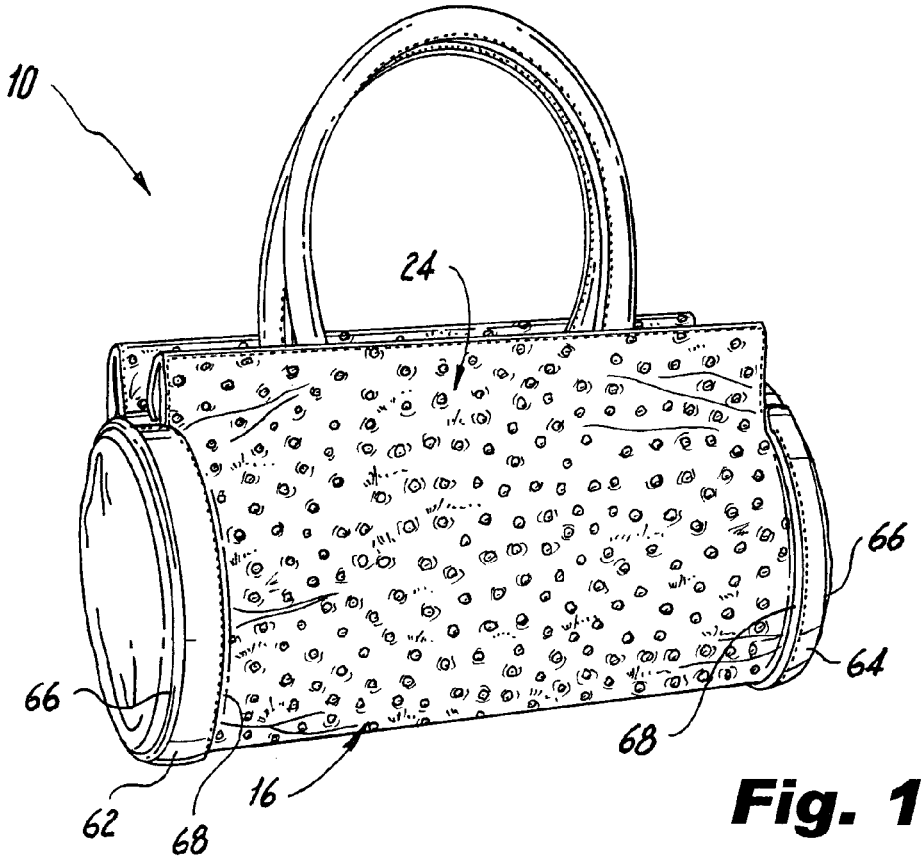
FIGS. 1, 2 and 3 are respectively front elevational views of a first, second and third selected appearance-enhancing decorative panel on a handbag article of manufacture according to the present invention.
Figure 2:
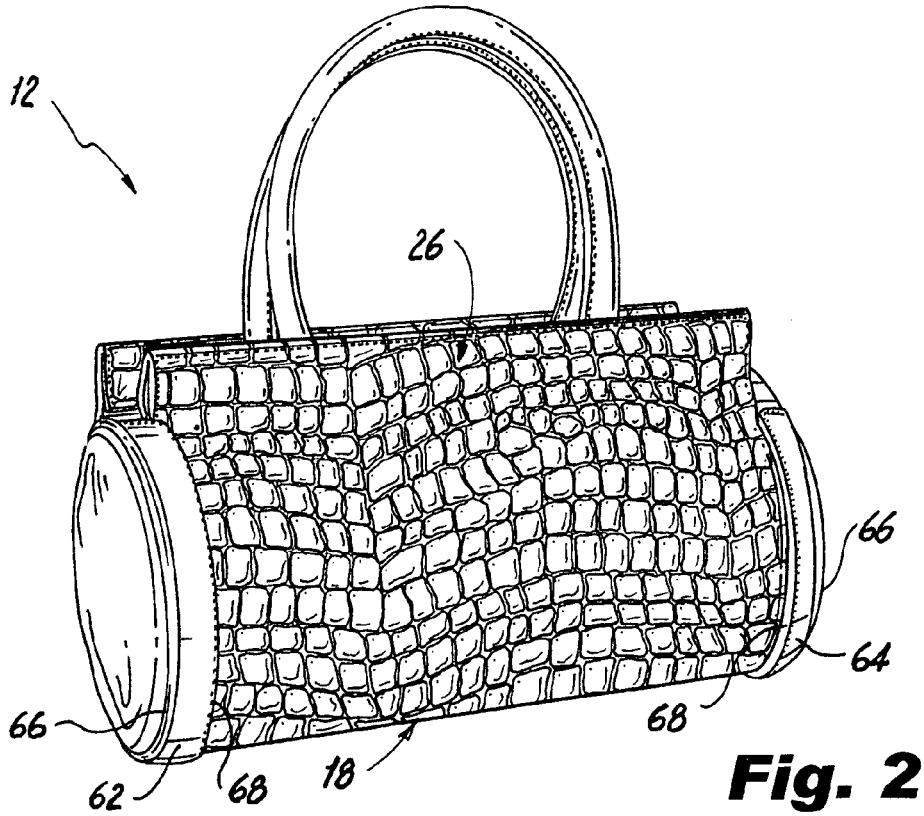
Figure 3:
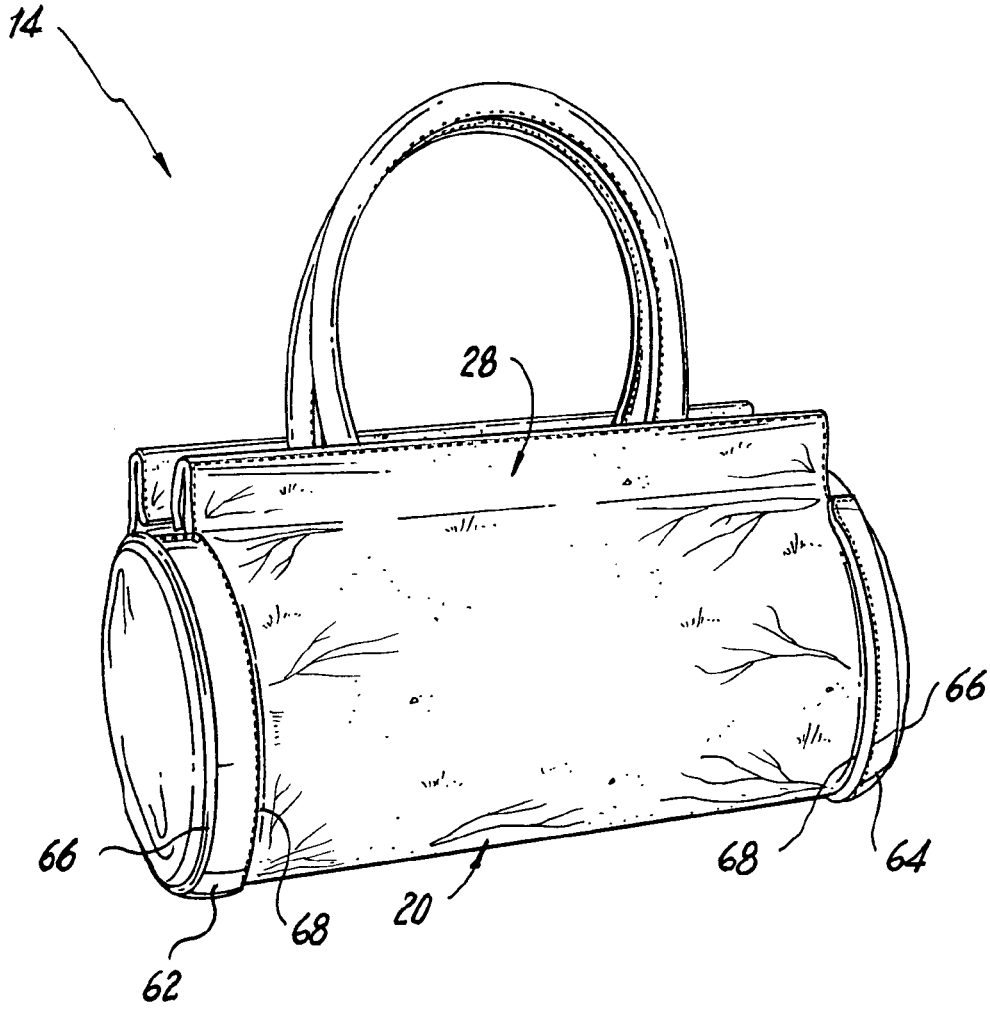

As will be better understood as the description proceeds, the handbags, generally designated 10, 12 and 14 are of similar construction as articles of manufacture, wherein the construction contributes to establishing a detachable attachment of a decorative panel, as noted at 16, 18 and 20, to cover a plain fabric body 22 (see FIG. 4) and instead display to a viewer a more fashionable appearance in the specific nature of an ostrich appearance 24 (FIG. 1), an embossment on leather 26 (FIG. 2), or an imprinted and textured fabric 28 (FIG. 3), to mention, but without limitation, and demonstrate interchangeability of display appearances provided by the noted decorative panels contemplated being used in accordance with the present invention.

Figure 4:
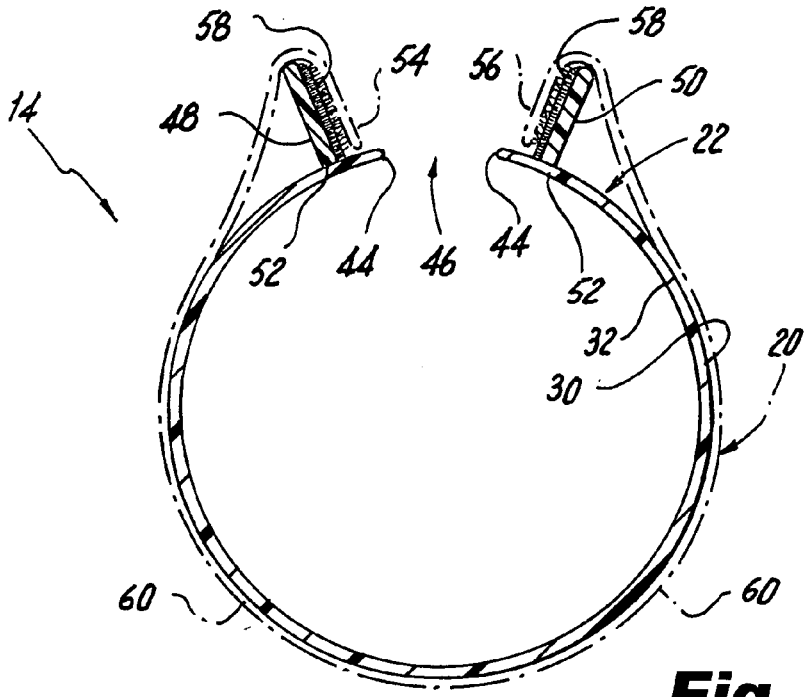
FIG. 4 is a view, on an enlarged scale, in cross section and partially schematic and simplified, illustrating details, common to all the handbags as decorated in FIGS. 1, 2 and 3, of applying the decorative panel to the handbag.
Figure 5:
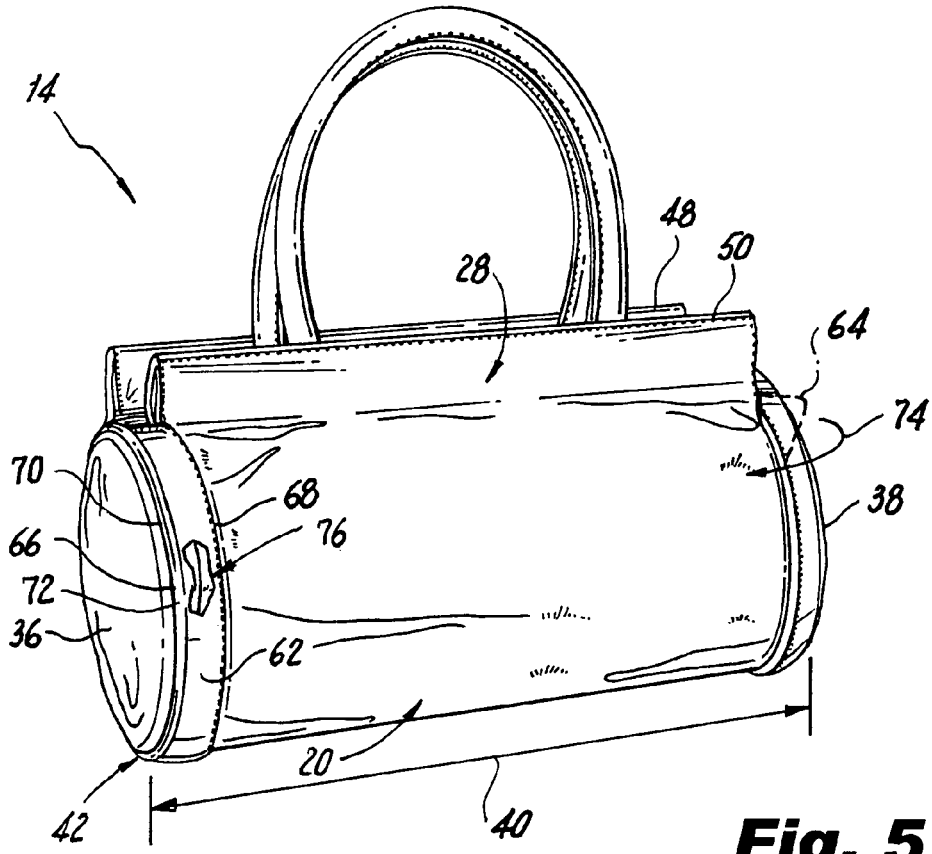
FIG. 5 is a front elevational view, similarly on an enlarged scale, illustrating details of maintaining in place a decorative panel applied to the handbag.

As best understood from FIGS. 4 and 5, the construction and the structural features thereof common to all of the handbags 10, 12 and 14, to achieve interchangeability of selected display or decorative panels exemplified by those noted, consists preferably of a semicircular horizontally oriented shaped handbag body 30 with a correspondingly shaped wall means 32 bounding an interior handbag compartment 34, the opposite ends of which compartment are closed by opposite spaced apart circular side panels 36 and 38, the spacing 40 therebetween determining the width size of the handbag. To be noted for their utility to be subsequently explained, are the circular peripheral edge 42 of the panels 36 and 38 which circumscribe their circular shapes.

A pair of adjacent edges 44 with a closure means (not shown) in their typical location along the top of each handbag, using handbag 14 of FIGS. 4, 5 as an example, bounds an opening 46 into compartment 34, and the handbag top is completed by a pair of two spaced apartment stiffened flaps 48 and 50 each connected at 52 to extend in outwardly divergent orientations, e.g., subtending an abtuse angle to the horizontal, are provided on opposite sides spaced from the compartment opening 46 for masking the presence of, and contributing to a neater appearance in the handbag top.

Of greater importance to appearance enhancement of the handbag 14 is a selected decorative panel 20 with opposite ends 54 and 56 having an operative position, as noted in FIG. 4, connected to a cooperating body flap 48, 50, using patches 5B of hook and loop fasteners adhesively secured to the panel ends 54, 56 and to inboard surfaces of the flaps 48, 50, after which connections the display panel 20 is sized to extend in a taut condition in a position in encircling relation about the handbag body, as noted at 60, thus covering the drab or plain appearance of the wall means 32 and instead displaying to a viewer an appearance of an imprinted and textured fabric 28.

In maintaining the thusly positioned display panel 20, use is made of two decorative or display panel-holding straps 62 and 64, each of a linear extent circumscribed by an outer edge 66 and an inner edge 68 as viewed in their FIG. 5 illustrated position attached to the handbag 14, the outer edges 66 being attached by seams 70 to the curved peripheral edges 72 of the end circular side panels 36, 38 and thus at the sites of attachment assuming the curvature of the peripheral edges 72. The strap inner edges 68 are unattached and consequently have a degree of movement through a pivotal traverse as depicted by arrow 74, transposing the position of edges 68 from an outer initial position to a subsequent inner position, which in effect folds each strap 62, 64 over a peripheral edge 72 of a display panel 20, as noted at 76, it being understood that the width of each display panel is selected to be of an extent to receive in superposed relation a strap 62, 64 undergoing a manually implemented fold-over in the application to the handbag of the display panel.

In practice the folded straps 62, 64 exert a sufficient gripping pressure on the opposite sides of the display panel 20, and there is obviated any inadvertent unfolding panel-releasing movement, because such movement is resisted by the curvature assumed by the outer strap edges 66 and to be overcome requires intended manual handling of the straps 62, 64.

While the handbag construction affording interchangeable appearance enhancement herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. An appearance-enhancing handbag article of manufacture comprising:

A. a semi-circular horizontally oriented shaped handbag body having a similarly shaped wall means bounding an interior handbag compartment and having opposite circular spaced apart side panels circumscribing a width of said body;

B. a pair of adjacent edges located along a top of said handbag body serving as an opening into said interior handbag compartment;

C. a pair of two spaced apart body flaps of stiffened construction material connected to extend in outwardly divergent orientations on opposite sides spaced from said opening into said interior handbag compartment;

D. a selected appearance-enhancing decorative panel with opposite ends having an operative position with each of said ends connected to a cooperating body flap and a length portion positioned in encircling relation about said handbag body;

E. at least two decorative panel-holding straps each having an outer edge and an inner edge in an operative attached position to said handbag body (1) means for attachment of said outer edge to a cooperating circular shaped handbag side panel and assuming an imparted semi-circular shape of said attachment, and (2) said inner edge being unattached and in a folded position against said handbag body; and F. operative positions of said straps assumed by a folding thereof in a pivotal transverse transposing from an outer to an inner position of said straps relative to sites of attachment of said straps;

whereby a folding of said straps apply a holding grip upon opposite peripheral sides edges of said decorative panel and an unfolding panel-releasing movement is resisted by said curvature assumed by said outer strap edges.

2. An appearance-enhancing handbag article of manufacture comprising:

A. a substantially circular horizontally oriented shaped handbag body having a similarly shaped wall means bounding an interior handbag compartment and having opposite curvilinear spaced apart side panels circumscribing a width of said body;

B. a pair of adjacent edges located along a top of said handbag body serving as an opening into said interior handbag compartment;

C. a pair of two spaced apart body flaps of stiffened construction material connected to extend in outwardly divergent orientations on opposite sides spaced from said opening into said interior handbag compartment;

D. a selected appearance-enhancing decorative panel with opposite ends having an operative position with each of said ends connected to a cooperating body flap and a length portion positioned in encircling relation about said handbag body;

E. at least two decorative panel-holding straps each having an outer edge and an inner edge in an operative attached position to said handbag body (1) means for attachment of said outer edge to a cooperating curvilinear shaped handbag side panel and assuming an imparted curvilinear shape of said attachment, and (2) said inner edge being unattached and in a folded position against said handbag body; and (3) operative positions of said straps assumed by a folding thereof in a pivotal transverse transposing from an outer to an inner position of said straps relative to sites of attachment of said straps;

whereby a folding of said straps apply a holding grip upon opposite peripheral sides edges of said decorative panel and an unfolding panel-releasing movement is resisted by said curvature assumed by said outer strap edges.

* * * * *